US006722620B2

(12) United States Patent
Rieger

(10) Patent No.: US 6,722,620 B2
(45) Date of Patent: Apr. 20, 2004

(54) SHELF SUPPORT

(76) Inventor: John P. Rieger, 2104 Crenshaw St., San Diego, CA (US) 92110

( * ) Notice: Subject to any disclaimer, the term of this patent is extended or adjusted under 35 U.S.C. 154(b) by 0 days.

(21) Appl. No.: 09/825,893

(22) Filed: Apr. 4, 2001

(65) Prior Publication Data

US 2002/0145094 A1 Oct. 10, 2002

(51) Int. Cl.[7] ..... A47G 29/02
(52) U.S. Cl. ..... 248/242; 248/250; 248/235
(58) Field of Search ..... 248/242, 235, 248/217.2, 250, 241; 108/108

(56) References Cited

U.S. PATENT DOCUMENTS 501,618 A * 7/1893 Higgins
3,041,033 A * 6/1962 Schwartz ..... 248/248
3,093,094 A * 6/1963 Oztekin ..... 108/6
4,077,081 A * 3/1978 Drumm ..... 15/181
4,086,737 A * 5/1978 Byrd, Jr. ..... 52/227
D260,852 S * 9/1981 Loeschen ..... D8/381
4,313,587 A * 2/1982 Loeschen ..... 248/217.2
4,382,571 A * 5/1983 Horen ..... 248/235
4,538,784 A * 9/1985 O'Flanagan ..... 248/244
D367,001 S * 2/1996 Bright ..... D8/381
5,620,160 A * 4/1997 Grabe ..... 248/235
D392,130 S * 3/1998 Wangler ..... D6/511
6,038,829 A * 3/2000 Franks ..... 52/645

* cited by examiner

*Primary Examiner*—Korie Chan
*Assistant Examiner*—Steven M Marsh
(74) *Attorney, Agent, or Firm*—David B. Waller & Associates

(57) ABSTRACT

The present invention provides a shelf support for mounting to a wall support beam comprising a top side having a width of a wall support beam, a back end, a front end and two sides wherein the two sides are adjacent to each other and perpendicular to the top side each having a rear end and a forward end wherein the rear end extends about 2 to about 4 inches past the back end of the top side and descends about 3 to about 10 inches from the top side and the forward end descends about 0 to about 1 inch from the top side and wherein the two sides each having at least two apertures, one aperture for pivotally mounting said shelf support to a wall support beam and the other aperture for adjusting the angle of said shelf support.

22 Claims, 5 Drawing Sheets

Figure 2
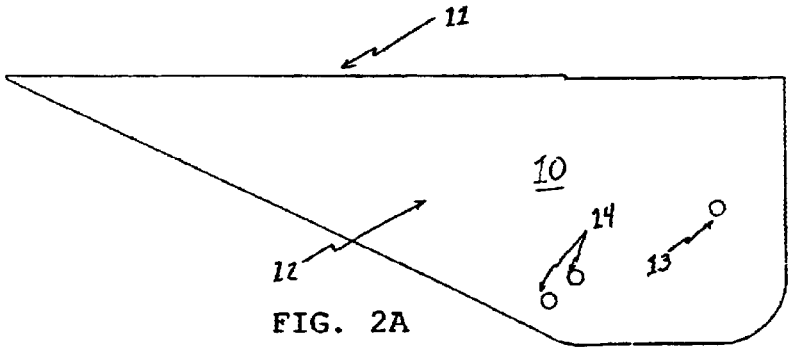
FIG. 2A
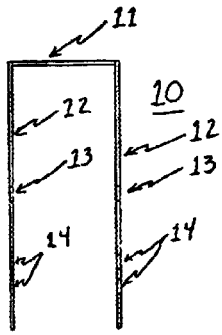
FIG. 2B
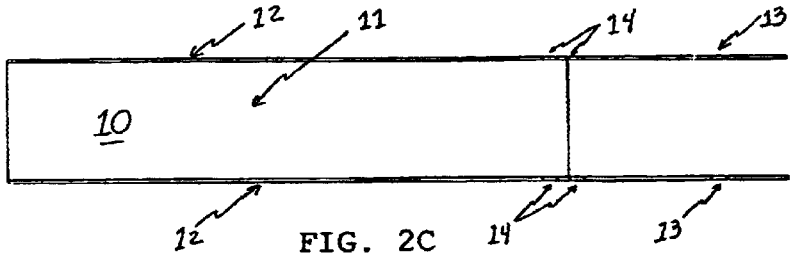
FIG. 2C

Figure 4
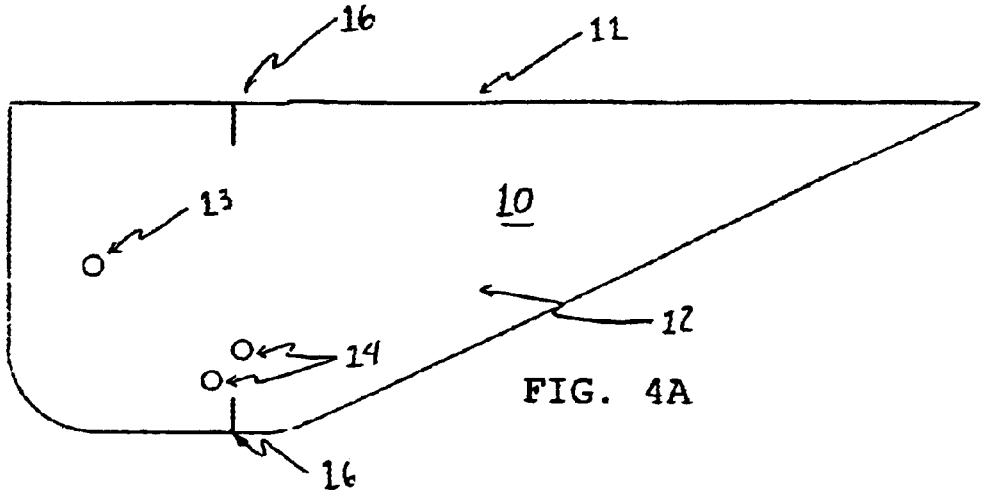
FIG. 4A
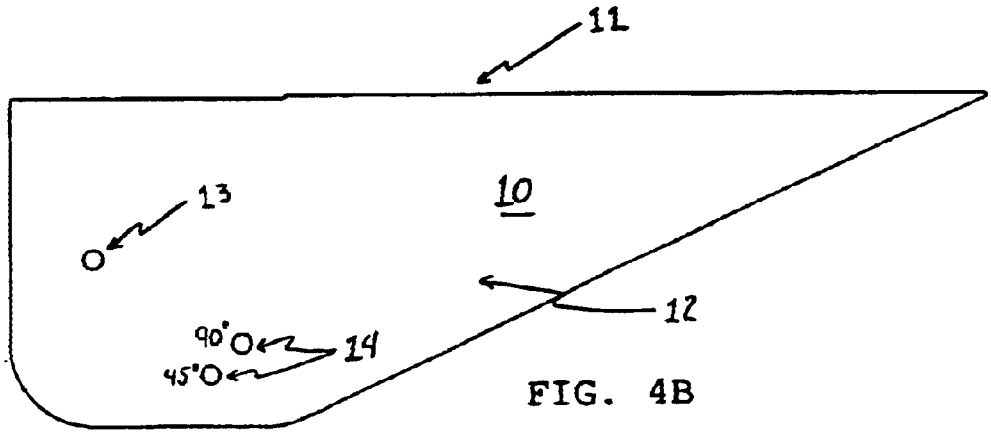
FIG. 4B

SHELF SUPPORT

TECHNICAL FIELD

The present invention relates to tools and hardware used in building and construction. In particular a novel shelf support.

BACKGROUND OF THE INVENTION

A number of wall mounting shelf supports are available on the market today. These include static fixed height supports and adjustable height wall mounting shelf support devices. The static fixed height shelf supports are fixed angle supports and secured to a wall by bolts or screws. There are several disadvantages to these types of shelf supports. More specifically the angle of the support cannot be adjusted, they cannot be easily detached from the wall without unscrewing the bolts securing the shelf support in place and when not in use the supports protrude from the wall and may cause injury to the user.

Adjustable height shelf support devices usually comprise a vertical mounting bar that is mounted to the wall by a series of screws or bolts and a number of shelf supports that may be removably affixed into the mounting bar. There are several disadvantages to this type of shelf support system. In particular, proper use of these systems requires that the vertical mounting bars be affixed to the wall parallel to each other. This is difficult for an inexperienced user to align the mounting bars such that they are relatively parallel. In addition, the mounting bars must be aligned horizontally so that the shelf supports when affixed to the mounting bar support a shelf evenly and so the shelf is level when placed on the supports. Finally these shelf supports are fixed angle supports and cannot be adjusted. Consequently the user must purchase more than one set of supports if different angles for the shelves are desired.

Therefore, there is a need for a shelf support that does not require additional equipment such as a vertical mounting bar, that may be adjusted to a desired angle and may be safely secured against the wall support when not in use.

SUMMARY OF THE INVENTION

The present invention provides a shelf support for mounting to a wall support beam comprising a top side having a width of a wall support beam, a back end, a front end and two sides wherein the two sides are adjacent to each other and perpendicular to the top side each having a rear end and a forward end wherein the rear end extends about 2 to about 4 inches past the back end of the top side and descends about 3 to about 10 inches from the top side and the forward end descends about 0 to about 1 inch from the top side and wherein the two sides each having at least two apertures, one aperture for pivotally mounting said shelf support to a wall support beam and the other aperture for adjusting the angle of said shelf support. The shelf support may be from about 3 inches to about 20 inches in length. Preferably, between about 6 inches to about 15 inches. Most preferably about 8 inches to about 12 inches.

In one embodiment of the present invention the shelf support further comprises an angle set pin to allow adjustment of the shelf support to a desired angle. The angle set pin may further comprise a locking means such as for example a nut, a flexible grommet, a retractable flange, a depressible ball and a cotter pin. In addition, the shelf support may further comprise an attachment means to attach the angle set pin to the shelf support. The attachment means may be a chain, a cord, a tie or a rope and may be made of a durable material such as metal, plastic or a combination of metal and plastic.

In another embodiment the shelf support further comprises at least one securing aperture on said top side to allow a shelf, for example, to be secured to the shelf support. In addition the shelf support may have at least one affixing means to allow items to be affixed to other areas than the top side of the shelf support. The affixing means may be a hole, a hook, a pin or a slot.

In yet another embodiment of the invention the rear ends of the two sides are shaped such that the shelf support can be pivoted downward and parallel with the wall support beam. To assist in mounting the shelf support on the wall support beam it may further comprise at least one alignment mark on one or both of the two sides. In addition, the shelf support of the present invention may further comprise a plurality of angle adjustment apertures to allow the user to select the desired angle of the mounted shelf support. The shelf support may further comprise degree markings adjacent to the plurality of apertures identifying corresponding adjustment angles for the shelf support.

In still another embodiment of the present invention the shelf support further comprises at least one adapter able to be secured into a securing aperture of the top side. The adapters may be used for mounting items such as a kayak, pipe, a bike, lumber.

In another aspect of the present invention kits are provided comprising at least one shelf support, a bolt for each shelf support to pivotally mount the support and an angle adjustment pin for each shelf support. One kit further comprises a hole drilling alignment device another kit further comprises at least one adapter.

DESCRIPTION OF THE FIGURES

FIG. 2: Is a diagrammatic representation of the shelf support showing a side view (A), the back view (B) and the bottom view (C);

FIG. 4: Is a diagrammatic representation of the shelf support showing a side view of the shelf support with an aligning mark (A) and a side view of the shelf support with a degree marking (B)

DETAILED DESCRIPTION OF THE INVENTION

Figure 1:
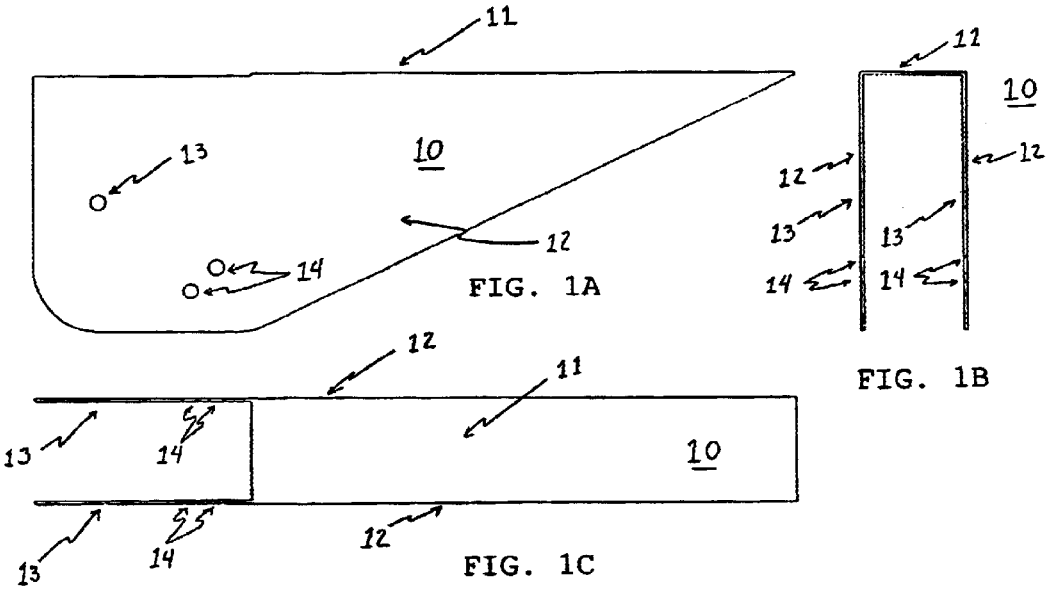
FIG. 1: Is a diagrammatic representation of the shelf support of the present invention showing a side view (A), the front view (B) and the top view (C)
Figure 3:
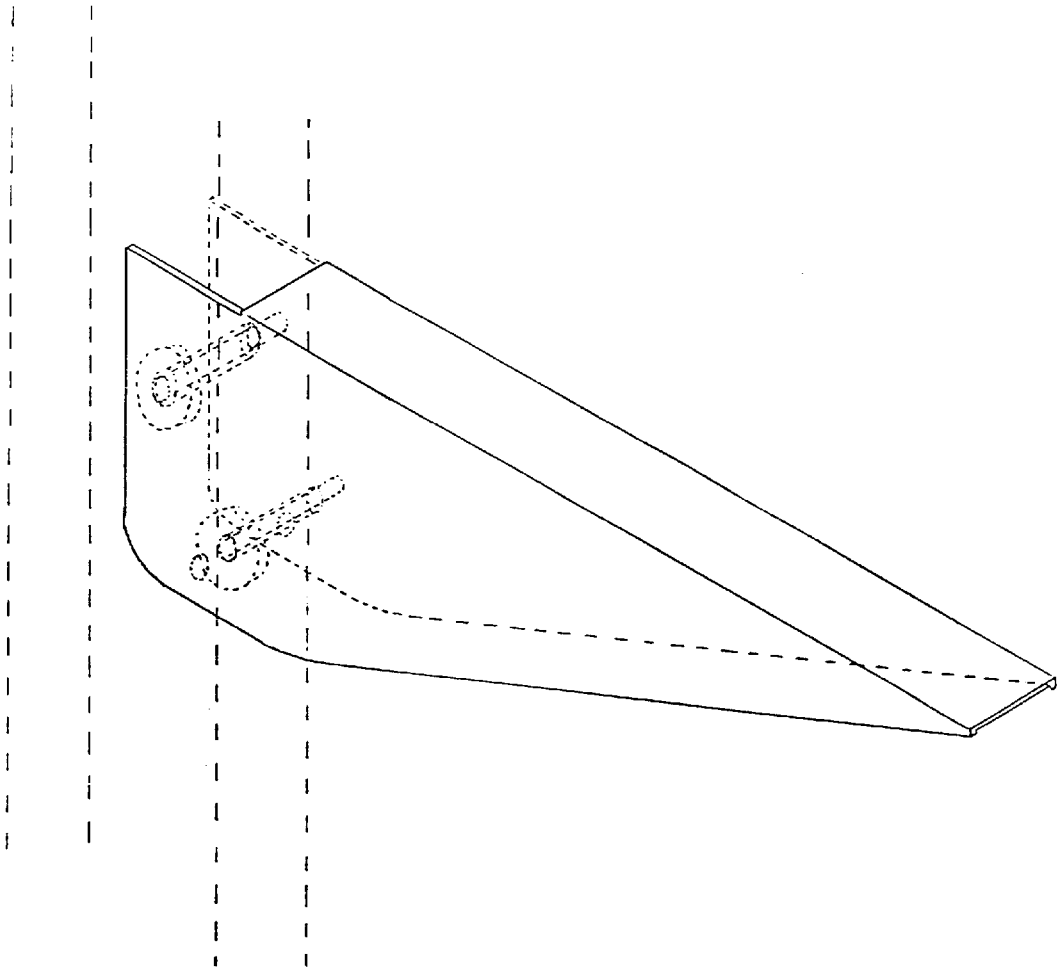
FIG. 3: Is a perspective view of the shelf support of the present invention.
Figure 5:
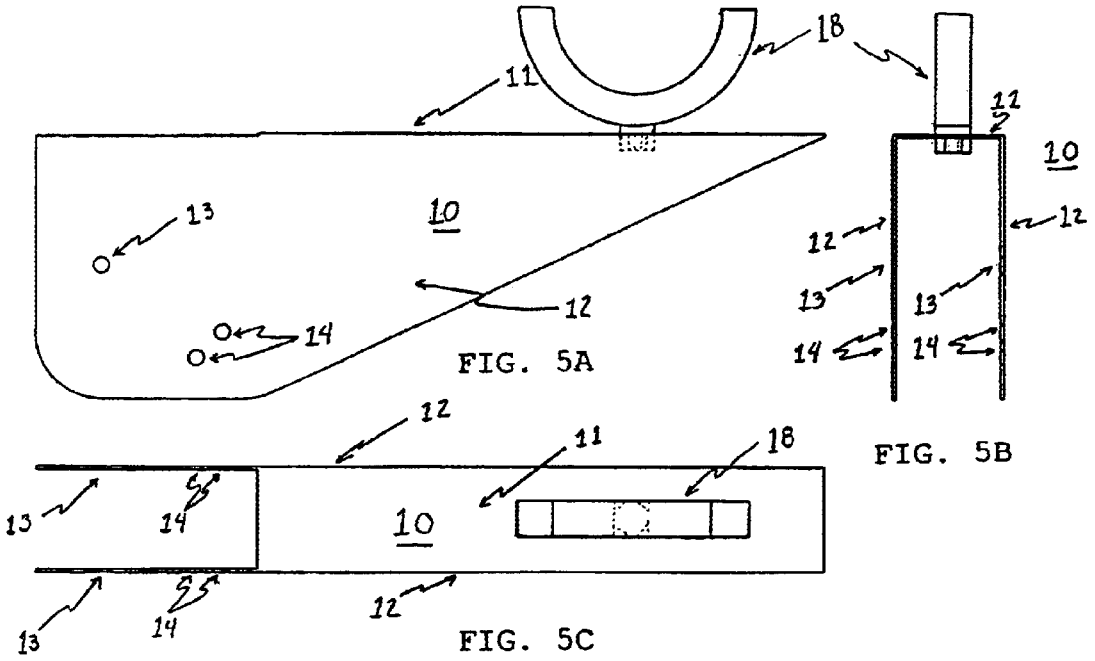
FIG. 5: Is a diagrammatic representation of the shelf support showing a side view of the shelf support with an adapter (A), a front view of the shelf support with an adapter (B) and a top view of the shelf support with an adapter (C).

The present invention provides a shelf support 10 for mounting to a wall support beam comprising a top side 11 having a width of a wall support beam, a back end, a front end and two sides wherein the two sides 12 are adjacent to each other and perpendicular to the top side 11 each having a rear end and a forward end wherein the rear end extends about 2 to about 4 inches past the back end of the top side 11 and descends about 3 to about 10 inches from the top side 11 and the forward end descends about 0 to about 1 inch from the top side 11 and wherein the two sides 12 each having at least two apertures, one aperture 13 for pivotally mounting said shelf support to a wall support beam and the other aperture 14 for adjusting the angle of said shelf support.

In the United States most homes are now built with construction beams of standard sizes such as 2" by 4", 2" by 6", 2" by 8" and in some cases 4" by 4" 4" by 6" and 4" by 8". In most cases the larger sizes are used for roof support beams while most walls are constructed with 2" by 4" beams. Most interior walls are covered with a dry wall board and finished with texturing, however, many garages are unfinished to save money. These exposed wall beams are well suited for use with the present invention. The standard beam with a 2" and 4" dimension when milled actually have a width of 1.5" and 3.5" respectively. The shelf support 10 of the present invention may be made in these as well as a variety of other sizes adapted to fit around a wall beam.

In addition the shelf support 10 of the present invention may be made in a variety of lengths to accommodate a number of different items such as for example, a shelf, loose pipe, lumber, a bike, a canoe or a kayak. Depending on the purpose will depend on the length used. More specifically, the shelf support 10 of the present invention ranges in length from 3" to 20", preferably from 6" to 15" and most preferably from 8" to 12". The shelf support 10 may be made of a variety of materials. The material selected will depend on the amount of weight the support 10 will be expected to hold. For example, if the weight is relatively light, possibly from 1 to 50 pounds only a few supports 10 will be required and the support 10 may be made of a light gauge metal or a heavier gauge aluminum or polymer. If the support 10 is expected to hold a substantially heavier weight such as 100 to 500 pounds a greater number of supports 10 may be required and the support 10 may be made of a heavy gauge metal or polymer.

The support 10 may be made from a single piece of material stock or may be a combination of one or more pieces joined together. For example if the structural material used to make the support 10 is a metal the one or more pieces may be joined together by welding, brazing or soldering. If the support 10 is made of a single piece of sheet material stock for example metal it may be punch pressed then folded into the final form. The support 10 may also be form molded or cast. For example, if the support 10 is made of a polymer it may be injection molded or if the support 10 is to be made of aluminum it maybe form cast in a mold. Preferably the shelf support 10 is constructed of a single piece of sheet metal that is folded into final form.

The top side 11 of the shelf support 10 is approximately the width of the wall support beam on which it is intended to be mounted. For example if the support beam is a 2" by 4" the top side 11 of the shelf support 10 is about 1.75" in width, correspondingly if the support beam is a 4" by 4" the top side 11 is about 3.75" in width. These widths offer more stability for securing items to the supports 10 then some commercially available supports. In particular those that utilize vertical mounting bars provide removable shelf supports that are less than or equal to ⅛" in width. The top side 11 may fur her comprise one or more apertures in its surface to allow the user to secure items to the supports 10. For example if the supports 10 are used to support a wood shelf the shelf may be secured to the supports 10 by screws utilizing the apertures provided. Alternatively, if the supports 10 are used to support a pipe an adapter 18 having a semicircular interface may be secured to the support by a bolt utilizing the apertures provided. The number of apertures may vary depending on the length of the shelf support 10 however, it is preferable that the top side 11 comprise from about 1 to about 20 apertures. More preferably the top side 11 may comprise from about 2 to about 10 apertures and most preferably from about 2 to about 6 apertures. In the fully mounted position the back end of the top side 11 is of a distance from the wall support beam to allow the shelf support 10 to be angled upward from about 90° to about 30° without impacting the wall support beam. Preferably the shelf support 10 ma be angled from about 90° to about 45°. Most preferably the angle is from about 90° to about 60°. This distance may be from about 1" to about 3".

The top side 11 may further comprise an affixing means on its underside. More specifically, an affixing means such as for example a hook may be affixed to the under side of the top side 11 so that the user may hang items from the underside of the shelf support 10. The hook could be affixed to the underside of the shelf support 10 utilizing one of the apertures provided in the top side 11 of the shelf support 10 or the hook may be permanently affixed to and be part of the shelf support 10. For example the hook could be attached to a metal shelf support 10 of the invention by welding, braising or soldering. If the shelf support 10 were form molded of a polymer the hook may be formed into the shelf support 10 mold. Alternatively, a flange or multiple flanges may be press cut from the shelf support top side 11. These flanges which are still connected to the top side 11 may be bent into the shape of hooks.

The two sides 12 of the shelf support 10 are adjacent to each other and generally perpendicular to the top side 11. The sides 12 of the shelf support 10 maybe formed in a variety of shapes and may be identical to each other or they may be different in shape from each other. Preferably the sides 12 are identical and are generally of a triangular shape being about 0 to about 1" at the forward end and about 3" to about 10" at the rear end. The sides 12 of the shelf support 10 extend past the back end of the top side 11 from about 2" to about 4" to allow the support 10 to fit around and be mounted on the support beam. Preferably the length of the sides 12 are shorter when the support beam width is from about 2" to about 4". If the support beams have widths from about 4" to about 8" the sides 12 are preferably longer. The rear end of the sides 12 may be tapered to allow the shelf support 10 to be rotated about the mounting aperture downward, parallel to the wall support beam and relatively flush to the wall. This tapering prevents the shelf support 10 from impacting the wallboard or stucco that may be present on the opposite side of the wall support beam that would inhibit the shelf support 10 rotation. The tapering may be a rounding of the rear end of the sides 12 preferably to the portion of the rear end farthest from the top side 11. Alternatively, a straight angled taper of the rear end may be preferred.

The two sides 12 also comprise one aperture 13 for mounting the shelf support 10 on a wall support beam and at least one aperture 14 for adjusting the angle of the shelf support 10. The mounting aperture 3 is positioned near the rear end of each side 12. These apertures 13 are aligned so that the mounting pin or bolt may easily inserted through the mounting aperture 13 of one side 12, through a mounting hole drilled in the wall support beam and through the mounting aperture 13 of the other side 12 of the shelf support 10 and secured in place. The aperture 13 may be from about 3/16" to about 5/8" in diameter. Preferably the aperture 13 is about ¼" to about ½" in diameter. The aperture 13 is positioned on the side 12 of the shelf support 10 to be about ½" to about 3" from the rear end of the shelf support 10 and about 1" to about 8" from the top side 11. Preferable the distance of the mounting aperture 13 from the top side 11 is such that when pivoting the shelf support 10 downward the rear end does not impact the wall board or stucco that may be present on the opposite side of the wall support beam preventing the shelf supports 10 rotation. This distance may be calculated by placing the shelf support 10 in its preferred mounted position and measuring the distance from the center of the mounting aperture 13 to the back of the all support beam. This distance minus the diameter of the mounting aperture 13 should not be exceeded when measuring the radial distance from the center of the mounting aperture 13 and the bottom of the side 12. One or both sides 12 of the shelf support 10 may further comprise an aligning mark 16 to allow easy installation of the shelf support 10 at the right depth in the wall support beam. This alignment mark 16 may be any type of mark or series of marks, placed or painted on or imprinted, scribed or stamped into the side 12. It may extend from the top to the bottom of the shelf support side 12 or the marks may be discontinuous appearing only on the top and bottom edges of the sides 12.

The two sides 12 also comprise at least one angle adjustment aperture 14 to allow the shelf support 10 to be adjusted to a desired angle. A number of angle adjustment apertures 14 may be provided. Preferably the shelf support 10 comprises two angle adjustment apertures 14, one aperture for a 90° setting and one for a 30°, 45° or 60° setting. Most preferably the shelf support 10 comprises about four angle adjustment settings one for 90°, 60°, 45° and 30° settings. These apertures 14 are aligned so that the angle adjustment pin or bolt may be easily inserted through the angle adjustment aperture 14 of one side 12, through the angle adjustment aperture 14 of the other side 12 of the shelf support 10 and secured in place. The aperture 14 may be from about 3/16" to about 5/8" in diameter. Preferably the aperture 14 is about 1/4" to about 1/2" in diameter. It is also preferable that the angle adjustment aperture 14 and the mounting aperture 13 be the same diameter. The angle adjustment apertures 14 are positioned from about 1/2" to about 2" from the bottom of the side 12. This distance is measured perpendicularly from the bottom of the side 12 to the center of the aperture 14. These apertures 14 may be aligned one after the other along the bottom of the side 12 or they may be clustered. In addition, the angle of adjustment may be indicated next to its corresponding aperture 14 for ease of use. The location of the angle adjustment apertures 14 may be determined by mounting the shelf support 10, raising the support 10 to the desired angle and making an aperture 14 such that when the angle adjustment pin is inserted through the aperture 14 the shelf support 10 retains that angle.

The sides 12 may further comprise at least one affixing means. The affixing means may be any type of means that allows the user to utilize the underside of the shelf support 10. These means include for example a hole, a hook, a pin, a slot, multiples of these means or any combination of these means. If the affixing means is a hole or slot or a number of holes or slots they may be located at any location on the side 12 of the shelf support 10 provided the holes are accessible for use. For example, an affixing means hole or slot is preferably not located on the rear end of the side 12 that is adjacent to the wall support beam where the wall support beam would prevent or block its use. Preferably the affixing means holes or slots are located about 1/4" to about 1" from the edge of the side 12 most distant from the top side 11. These affixing means may be aligned linearly or clustered. If the affixing is a pin or a hook they may be in any location on the side 12. Preferably they would be located about 1/4" to about 1" from the edge of the side 12 most distant from the top side 11.

The angle set pin used to fix the angle of the shelf support 10 may be any size or shape able to be fitted through the angle adjustment aperture 14. The angle adjustment pin is made of any material having a strength able to resist deformation under pressure from weights as much as 500 pounds or more. The pin may be made of a material such as metal, high-density polymer, fiberglass or any combination thereof. Preferably the angle adjustment pin has a diameter slightly smaller than the angle adjustment aperture 14 to provide a snug fit when passing the pin through the aperture 14. The pin is preferably cylindrical and of a length that traverses the angle adjustment apertures 14 of both sides 12. Preferably the pin has a head on one side that is larger that the angle adjustment aperture 14 and a locking means on the other side for securing the pin in place. The locking means can be any means that tends to prevent the pin from being displaced from the angle adjustment apertures 14 when in use. Locking means may include for example a nut, a flexible grommet, a retractable flange, a depressible ball or a cotter pin.

The angle adjustment pin may be affixed to the shelf support 10 by an attachment means. The attachment means could be made of for example a chain, a cord, a tie or a rope and made of a material that is durable and flexible such as metal, plastic or a combination of metal and plastic. Preferably the angle adjustment pin head is affixed to one end of the attachment means and the other end of the attachment means is affixed to the shelf support 10. The attachment means may be secured to the shelf support 10 and to the pin by a variety of methods including for example, welding, soldering, gluing, tying, riveting or bolting.

The mounting pin may be made similarly to the angle adjustment pin. Preferably the mounting pin is a bolt such that when the shelf support 10 is mounted it may be securely fastened to the wall support beam by a nut screwed onto one end of the bolt.

The shelf supports 10 of the present invention may be provided in packages of two to twenty-four. Preferably the packages will contain from two to eight shelf supports 10. The packages may also contain one mounting pin and one angle adjustment pin for each shelf support 10. In addition, the package may contain a hole drilling alignment device or one or more adapters that may be affixed to the top side 11 of the shelf support 10 after mounting.

What is claimed is:

1. A pivotally mounted self support, in combination with a wall support beam having two side surfaces and a front surface for providing support, comprising:

(a) the pivotally mounted support element having a top surface and two sides;

wherein said two sides extend rearward from the front surface of the beam, thereby flanking the side surfaces of the beam; and wherein each side has a mounting aperture and at least one angle adjustment aperture;

(b) a mounting pin, wherein said mounting pin passes through the mounting aperture of one side, through the beam, and through the mounting aperture of the other side; and (c) an angle set pin, wherein said angle set pin passes through a angle adjustment aperture of one side, and through a corresponding angle adjustment aperture of the other side, but does not pass through the beam;

wherein when said angle set pin is present, any weight applied to said top surface is resisted by contact between said angle set pin and the front surface of the beam; and wherein when said angle set pin is not present, said support element is partially rotatable around the lengthwise axis of said mounting pin.

2. The shelf support according to claim 1, wherein the length of said shelf support is from about 3 inches to about 20 inches.

3. The shelf support according to claim 1, wherein the length of said shelf support is from about 6 inches to about 15 inches.

4. The shelf support according to claim 1, wherein the length of said shelf support is from about 8 inches to about 12 inches.

5. The shelf support according to claim 1, wherein said angle set pin comprises a locking means selected from the group consisting of a nut, a flexible grommet, a retractable flange, a depressible ball, and a cotter pin.

6. The shelf support according to claim 1, wherein said shelf support further comprises an attaching means to attach said angle set pin to said shelf support element.

7. The shelf support according to claim 6, wherein said attaching means is selected from the group consisting of a chain, a cord, a tie, and a rope.

8. The shelf support according to claim 6, wherein said attaching means is made of a durable material selected from the groups consisting of metal, plastic, and a combination of metal and plastic.

9. The shelf support according to claim 1, wherein a side has at least one a fixing means.

10. The shelf support according to claim 9, wherein said affixing means is selected from the group consisting of a hole, a hook, a pin, and a slot.

11. The shelf support according to claim 1, wherein if said angle set pin is not present, said support element permits rotation until said top side is parallel with the beam.

12. The shelf support according to claim 1, wherein said support element comprises an aligning mark on at least one of said two sides.

13. The shelf support according to claim 1, wherein each side has a plurality of angle adjustment apertures.

14. The shelf support according to claim 13, wherein each side has 2, 3, or 4 angle adjustment apertures.

15. The shelf support according to claim 13, wherein each side has an angle adjustment aperture corresponding to at least one angle adjustment setting selected from the group consisting of 90°, 60°, 45°, and 30°.

16. The shelf support according to claim 13, wherein said shelf support element comprises a degree marking adjacent to a corresponding angle adjustment aperture.

17. The shelf support according to claim 1, wherein said top side comprises at least one securing aperture.

18. The shelf support according claim 17, wherein said shelf support element further comprises at least one adapter capable of being secured into said securing aperture.

19. The shelf support according to claim 18, wherein said adapter is for mounting an item on said shelf support, wherein the item is selected from the group consisting of lumber, pipe, a kayak, and a bike.

20. A kit, comprising at least one shelf support according to claim 1, at least one mounting pin, and at least one angle set in.

21. The kit according to claim 20, further comprising a device for aligning the position of holes to be drilled.

22. The kit according to claim 20, further comprising at least one adapter.

* * * * *